US006380912B1

(12) United States Patent
Kang et al.

(10) Patent No.: US 6,380,912 B1
(45) Date of Patent: Apr. 30, 2002

(54) METHOD FOR DRIVING PLASMA DISPLAY PANEL

(75) Inventors: Kyoung-ho Kang, Asan; Jeong-duk Ryeom, Cheonan, both of (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/512,341

(22) Filed: Feb. 24, 2000

(30) Foreign Application Priority Data

Feb. 27, 1999 (KR) ..... 99-6645

(51) Int. Cl.[7] ..... G09G 3/28
(52) U.S. Cl. ..... 345/60; 345/67; 345/68
(58) Field of Search ..... 345/60, 61, 62, 345/63, 66, 68, 67; 315/169.4, 169.1, 169.2

(56) References Cited

U.S. PATENT DOCUMENTS 5,331,252 A 7/1994 Kim ..... 315/169.4
5,670,974 A 9/1997 Ohba et al. ..... 345/60
6,097,358 A * 8/2000 Hirakawa et al. ..... 345/63
6,144,349 A * 11/2000 Awata et al. ..... 345/67
6,262,699 B1 * 7/2001 Suzuki et al. ..... 345/68
6,288,693 B1 * 9/2001 Song et al. ..... 345/68
6,326,736 B1 * 12/2001 Kang et al. ..... 315/169.4

FOREIGN PATENT DOCUMENTS

JP 8-152865 6/1996

* cited by examiner

*Primary Examiner*—Xiao Wu
(74) *Attorney, Agent, or Firm*—Leydig, Voit & Mayer, Ltd.

(57) ABSTRACT

A method for driving a plasma display panel in which a reset step of erasing remaining wall charges from a previous sub-field, an address step of forming wall charges in a selected pixel area, and a sustain discharge step of generating light from pixels where the wall charges are generated in the address step by applying alternating pulses to scan electrode lines and common electrode lines arranged parallel to each other, are sequentially performed in a unit sub-field, including allocating the scan electrode lines and the common electrode lines into groups, and applying alternating pulses to the scan electrode lines and common electrode lines in each group in the address step.

2 Claims, 7 Drawing Sheets

METHOD FOR DRIVING PLASMA DISPLAY PANEL

BACKGROUND OF THE INVENTION

1. Field of the Invention

The present invention relates to a method for driving a plasma display panel and, more particularly, to a method for driving a three-electrode surface-discharge alternating-current plasma display panel.

2. Description of the Related Art

FIG. 1 shows an electrode line pattern of a general three-electrode surface-discharge alternating-current plasma display panel, FIG. 2 shows a cell forming a pixel of the plasma display panel shown in FIG. 1, and FIG. 3 shows another example of a pixel of the panel shown in FIG. 1. Referring to the drawings, in a general three-electrode surface-discharge alternating-current plasma display panel, address electrode lines $A_1, A_2, A_3, \ldots, A_{m-2}, A_{m-1}$ and $A_m$, a dielectric layer 11 (and/or 141 of FIG. 3), scan electrode lines $Y_1, Y_2, \ldots, Y_{n-1}$ and $Y_n$, common electrode lines $X_1, X_2, \ldots, X_{n-1}$ and $X_n$ and a MgO protective film 12 are provided between front and rear glass substrates 10 and 13 of a general surface-discharge plasma display panel 1.

The address electrode lines $A_1, A_2, A_3, \ldots, A_{m-2}, A_{m-1}$ and $A_m$, coat the entire surface of the rear glas substrate 13 in a predetermined pattern. Phosphors (142 of FIG. 3) may coat the entire surface of the scan electrode lines $Y_1, Y_2, \ldots, Y_{n-1}$ and $Y_n$. Otherwise, the phosphors 142 may coat the dielectric layer 141 in the event the dielectric layer is coated over the entire surface of the scan electrode lines $Y_1, Y_2, \ldots, Y_{n-1}$ and $Y_n$ in a predetermined pattern.

The common electrode lines $X_1, X_2, \ldots, X_{n-1}$ and $X_n$ and the scan electrode lines $Y_1, Y_2, \ldots, Y_{n-1}$ and $Y_n$ are arranged on the rear surface of the front glass substrate 10, orthogonal to the address electrode lines $A_1, A_2, A_3, \ldots, A_{m-2}, A_{m-1}$ and $A_m$ in a predetermined pattern. The respective intersections define corresponding pixels. The common electrode lines $X_1, X_2, \ldots, X_{n-1}$ and $X_n$ and the scan electrode lines $Y_1, Y_2, \ldots, Y_{n-1}$ and $Y_n$ each comprise indium tin oxide (ITO) electrode lines $X_{na}$ and $Y_{na}$, and metal bus electrode lines $X_{nb}$ and $Y_{nb}$, as shown in FIG. 3. The dielectric layer 11 entirely coats the rear surface of the common electrode lines $X_1, X_2, \ldots, X_{n-1}$ and $X_n$ and the scan electrode lines $Y_1, Y_2, \ldots, Y_{n-1}$ and $Y_n$. The MgO protective film 12 for protecting the panel 1 against strong electrical fields entirely coats the rear surface of the dielectric layer 11. A gas for forming a plasma is hermetically sealed in a discharge space.

The driving method generally adopted for the plasma display panel described above is an address/display separation driving method in which a reset step, an address step and a sustain discharge step are sequentially performed in a unit sub-field. In the reset step, wall charges remaining in the previous sub-field are erased. In the address step, the wall charges are formed in a selected pixel area. Also, in the sustain discharge step, light is produced at the pixel at which the wall charges are formed in the address step. In other words, if alternating pulses of a relatively high voltage are applied between the common electrode lines $X_1, X_2, \ldots, X_{n-1}$ and $X_n$ and the scan electrode lines $Y_1, Y_2, \ldots, Y_{n-1}$ and $Y_n$, a surface discharge occurs at the pixel at which the wall charges are formed. Here, a plasma is formed in the gas layer of the discharge space 14 and the phosphors 142 are excited by ultraviolet rays to thus emit light.

Here, several unit sub-fields basically operating on the principles as described above are contained in a unit frame, thereby achieving a desired gray scale display by sustain discharge time intervals of the respective sub-fields.

In the sustain discharge step of the above-described method for driving the plasma display panel 1, conventionally, the timing of alternating pulses applied to all scan electrode lines $Y_1, Y_2, \ldots, Y_{n-1}$ and $Y_n$, are constant, and the timings of alternating pulses applied to all common electrode lines $X_1, X_2, \ldots, X_{n-1}$ and $X_n$ is also constant.

Accordingly, since the overall driving current flowing at the timing at which alternating pulses are applied to all scan electrode lines $Y_1, Y_2, \ldots, Y_{n-1}$ and $Y_n$, or all common electrode lines $X_1, X_2, \ldots, X_{n-1}$ and $X_n$ become considerably large, an apparatus for preventing electrical shock to the plasma display panel 1 and the driving apparatus (not shown) are further necessary. Also, electromagnetic interference increases.

SUMMARY OF THE INVENTION

To solve the above problem, it is an objective of the present invention to provide a method for driving a plasma display panel which can reduce electromagnetic interference without applying an electrical shock to a plasma display panel and a driving apparatus therefor.

Accordingly, to achieve the above objective, there is provided a method for driving a plasma display panel in which a reset step of erasing remaining wall charges from a previous sub-field, an address step of forming wall charges in a selected pixel area, and a sustain discharge step of generating light from pixels where the wall charges are generated in the address step by applying alternating pulses to scan electrode lines and common electrode lines arranged parallel to each other, are sequentially performed in a unit sub-field the method including the steps of allocating the scan electrode lines and the common electrode lines into a plurality of groups, and applying the alternating pulses to the scan electrode lines and common electrode lines allocated into each group in the address step.

In the sustain discharge step, the alternating pulses are preferably applied to the respective scan electrode lines and a common scan electrode which is not adjacent to the respective scan electrode lines at the same timing.

Therefore, since the amount of overall driving current flowing at a the timing at which alternating pulses are applied to all scan electrode lines $Y_1, Y_2, \ldots, Y_{n-1}$ and $Y_n$, or all common electrode lines $X_1, X_2, \ldots, X_{n-1}$ and $X_n$ become considerably reduced, electrical shock to the plasma display panel and a driving apparatus therefor can be prevented and electromagnetic interference can be reduced.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 4:
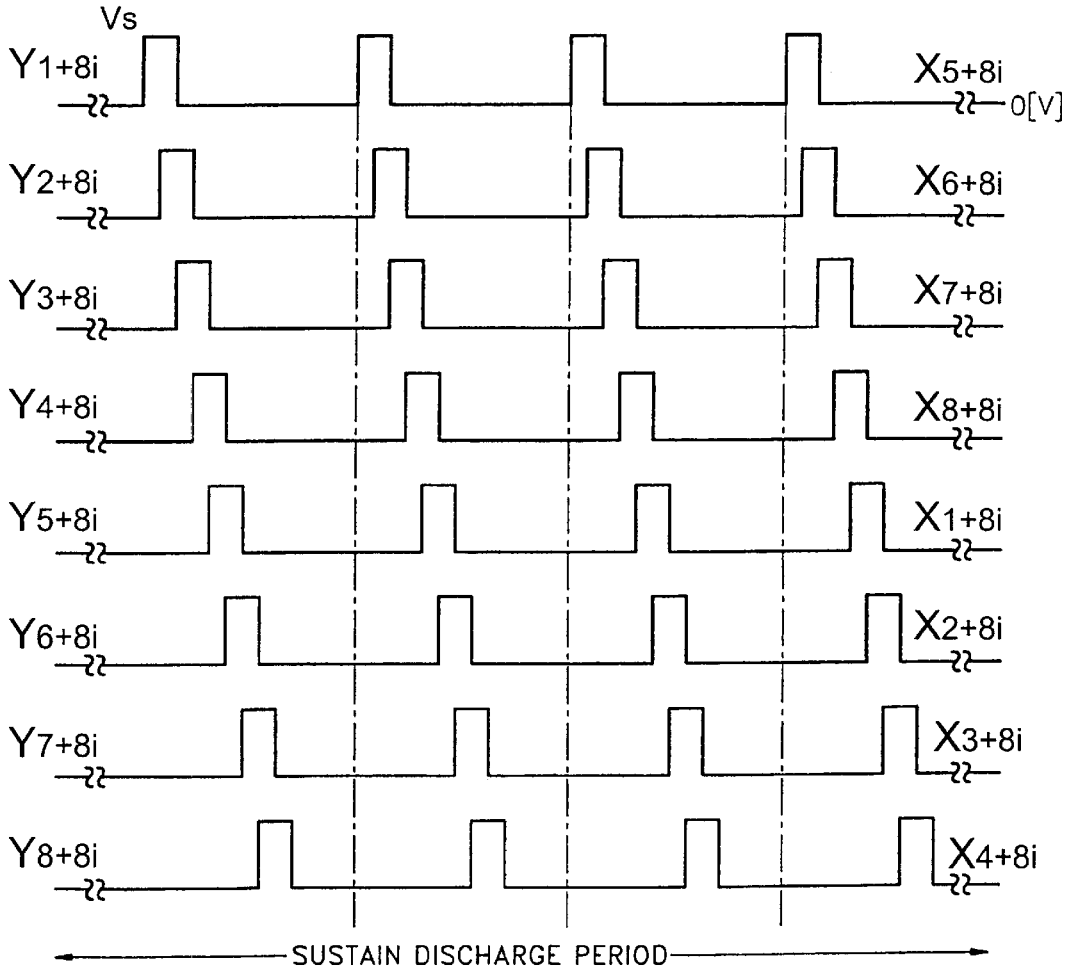
FIG. 4 is a timing diagram showing a method for driving a plasma display panel according to a first embodiment of the present invention.

Referring to FIG. 4 showing a method for driving a plasma display panel according to a first embodiment of the present invention, scan electrode lines ($Y_1, Y_2, \ldots, Y_{n-1}$ and $Y_n$ of FIG. 1) and common electrode lines ($X_1, X_2, \ldots, X_{n-1}$ and $X_n$ of FIG. 1) are allocated to a plurality of groups. Each group has 8 scan electrode lines and 8 common electrode lines. For example, first through eighth scan electrode lines $Y_1$ through $Y_8$ and first through eighth common electrode lines $X_1$ through $X_8$ are allocated to a first group. Also, ninth through sixteenth scan electrode lines $Y_9$ through $Y_{16}$ and ninth and sixteenth common electrode lines $X_9$ through $X_{16}$ are allocated to a second group. This will be generalized such that (1+8i)-th through (8+8i)-th scan electrode lines $Y_{1+8i}$ through $Y_{8+8i}$ and (1+8i)-th through (8+8i)-th common electrode lines $X_{1+8i}$ through $X_{8+8i}$ are allocated to each group. Here, I is an integer corresponding to each group number.

In a sustain discharge period, alternating pulses are applied to the scan electrode lines $Y_{1+8i}, \ldots$ and $Y_{8+8in}$ and the common electrode lines $X_{1+8i}, \ldots$ and $X_{8+8i}$ with a constant time interval. Also, alternating pulses are applied to the scan electrode lines $Y_{1+8i}, \ldots$ and $Y_{8+8in}$ and one of the common electrode lines $X_{1+8i}, \ldots$ and $X_{8+8i}$ which are not adjacent to the scan electrode lines $Y_{1+8i}, \ldots$ and $Y_{8+8in}$ at the same time. For example, alternating pulses are applied to the (1+8i)-th scan electrode line $Y_{1+8i}$ and the (5+8i)-th common electrode line $X_{5+8i}$ at the same time. Conversely, alternating pulses are applied to the (1+8i)-th common electrode line $X_{1+8i}$ and the (5+8i)-th scan electrode line $Y_{5+8i}$ at the same time.

Figure 5:
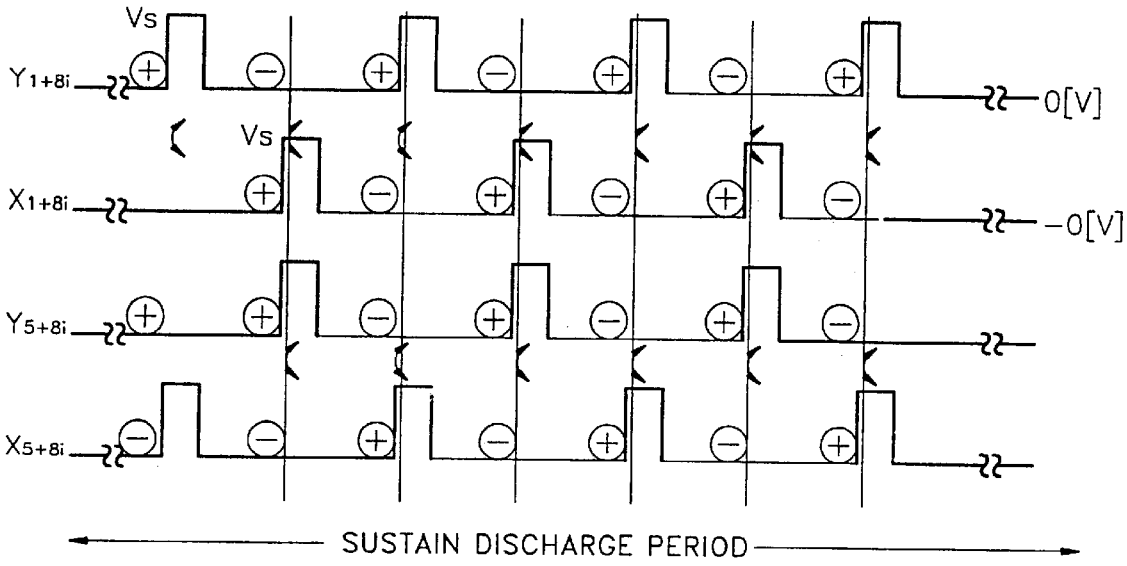
FIGS. 5 and 6 are extracted timing diagrams for explaining the driving method shown in FIG. 4.
Figure 6:
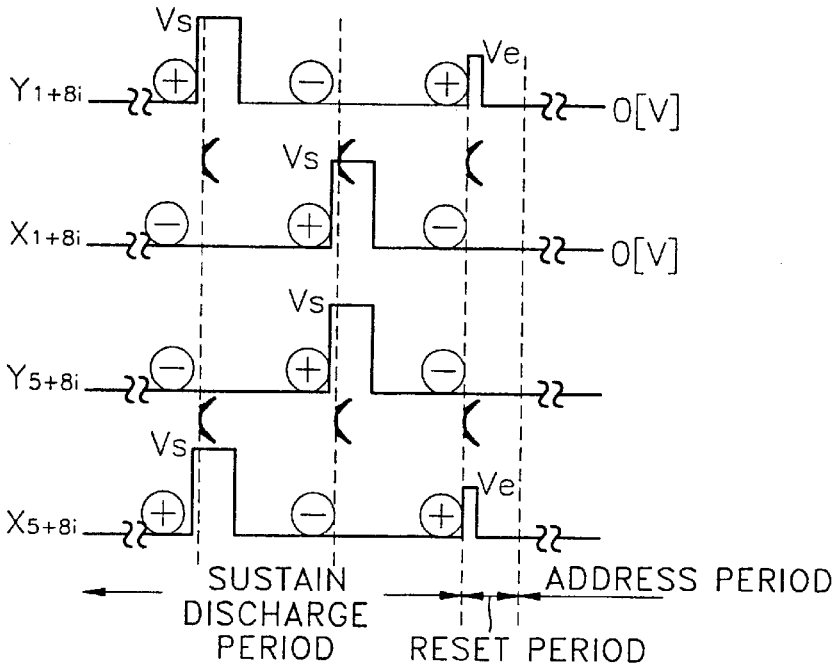

FIGS. 5 and 6 are extracted timing diagrams for explaining the driving method shown in FIG. 4.

Referring to FIG. 5, positive pulses are applied to the (1+8i)-th scan electrode line $Y_{1+8i}$ and the (5+8i)-th common electrode line $X_{5+8i}$ at the same time. Here, it is assumed that positive wall charges are produced around the scan electrode of all pixels selected in performing the address step, and negative wall charges are produced around the common electrode. Accordingly, in the sustain discharge period, if first positive pulses are applied to the (1+8i)-th scan electrode line $Y_{1+8i}$ and the (5+8i)-th common electrode line $X_{5+8i}$, a display discharge occurs in the area of the pixels selected between the (1+8i)-th scan electrode line $Y_{1+8i}$ and the (1+8i)-th common electrode line $X_{1+8i}$. However, a display discharge does not occur in the area of the pixels selected between the (5+8i)-th common electrode line $X_{5+8i}$ and the (5+8i)-th scan electrode line $Y_{5+8i}$. Accordingly, the direction of the alternating current flowing between the ($_{1+8}$i)-th scan electrode line $Y_{1+8i}$ and the (5+8i)-th common electrode line $X_{5+8i}$ is opposite to that of the alternating current flowing between the (5+8i)-th common electrode line $X_{5+8i}$ and the (5+8i)-th scan electrode line $Y_{5+8i}$. Also, at the final time of the sustain discharge period, the wall charges produced around the (1+8i)-th scan electrode line $Y_{1+8i}$ have an opposite polarity to that of the wall charges produced around the (5+8i)-th common electrode line $X_{5+8i}$. Similarly, the-wall charges produced around the (1+8i)-th common electrode line $X_{1+8i}$ have an opposite polarity to that of the wall charges produced around the (5+8i)-th common electrode line $X_{5+8i}$.

Referring to FIG. 6, at the last timing of the sustain discharge period, while the wall charges produced around the (1+8i)-th scan electrode line $Y_{1+8i}$ are positive, the wall charges produced around the (5+8i)-th common electrode line $X_{5+8i}$ are negative. Also, at this time, while the wall charges produced around the (1+8i)-th common electrode line $X_{1+8i}$ are negative, the wall charges produced around the (5+8i)-th common electrode line $X_{5+8i}$ are positive. Accordingly, in the reset period, positive pulses having a reset voltage Ve must be applied to the scan electrode lines $Y_{1+8i}, \ldots$ and common electrode lines $X_{5+8i}, \ldots$ around which positive wall charges are produced.

Figure 1:
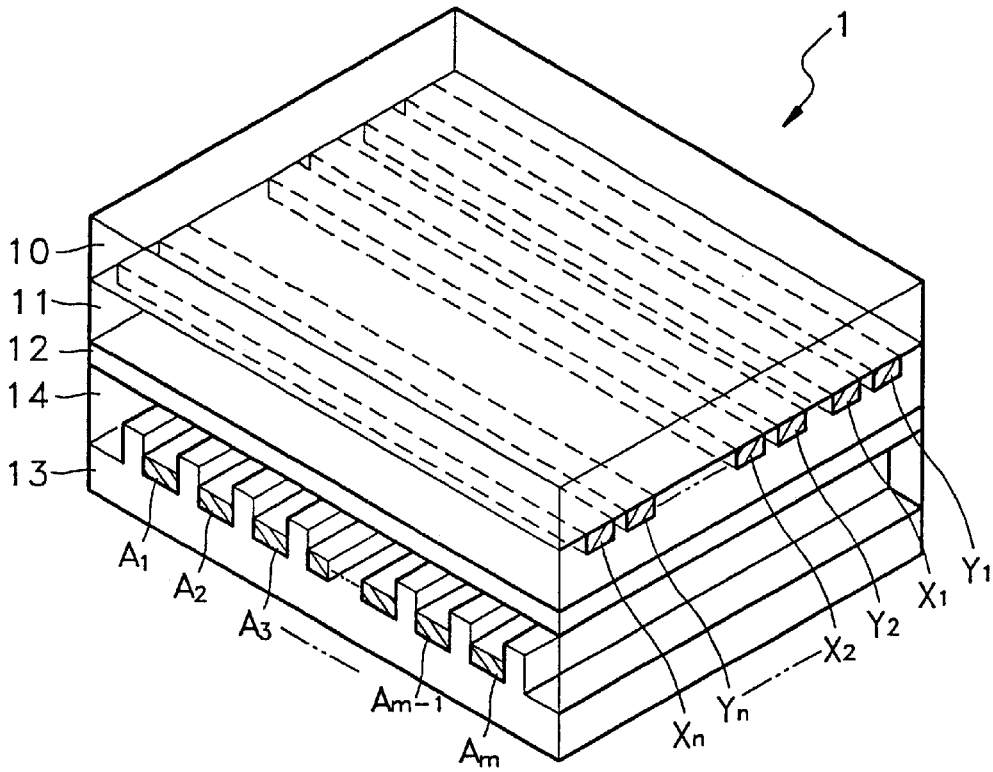
FIG. 1 shows an electrode line pattern of a general three-electrode surface-discharge alternating-current plasma display panel.
Figure 2:
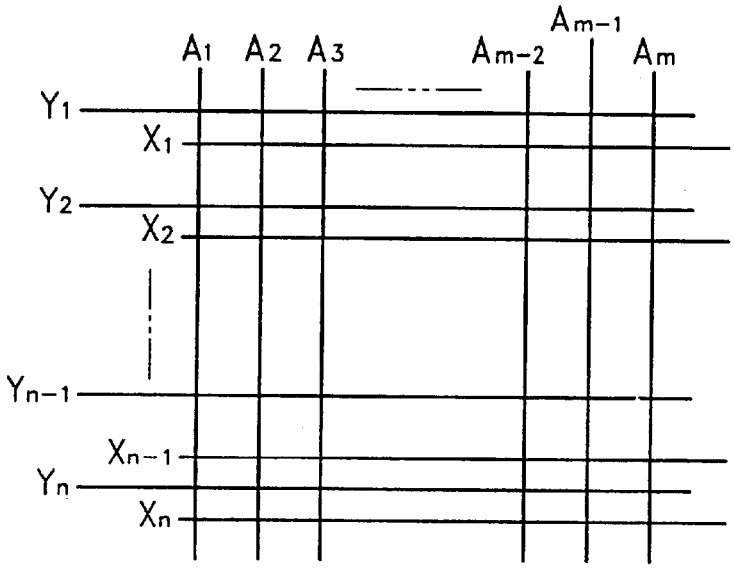
FIG. 2 is a cross section of a cell forming a pixel of the panel shown in FIG. 1.
Figure 3:
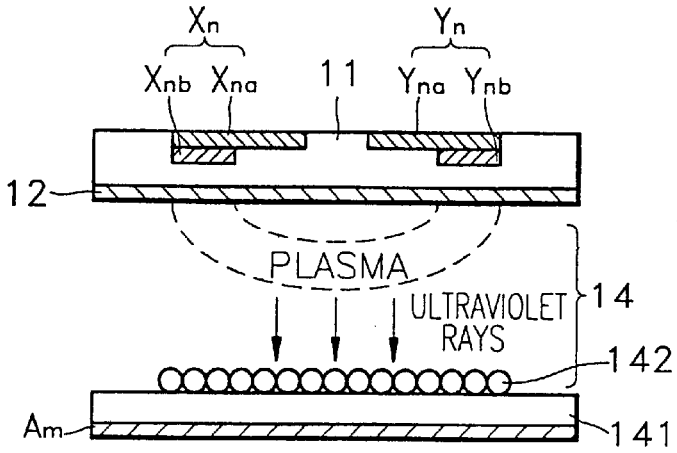
FIG. 3 is a cross section of a pixel of the panel shown in FIG. 1.
Figure 7:
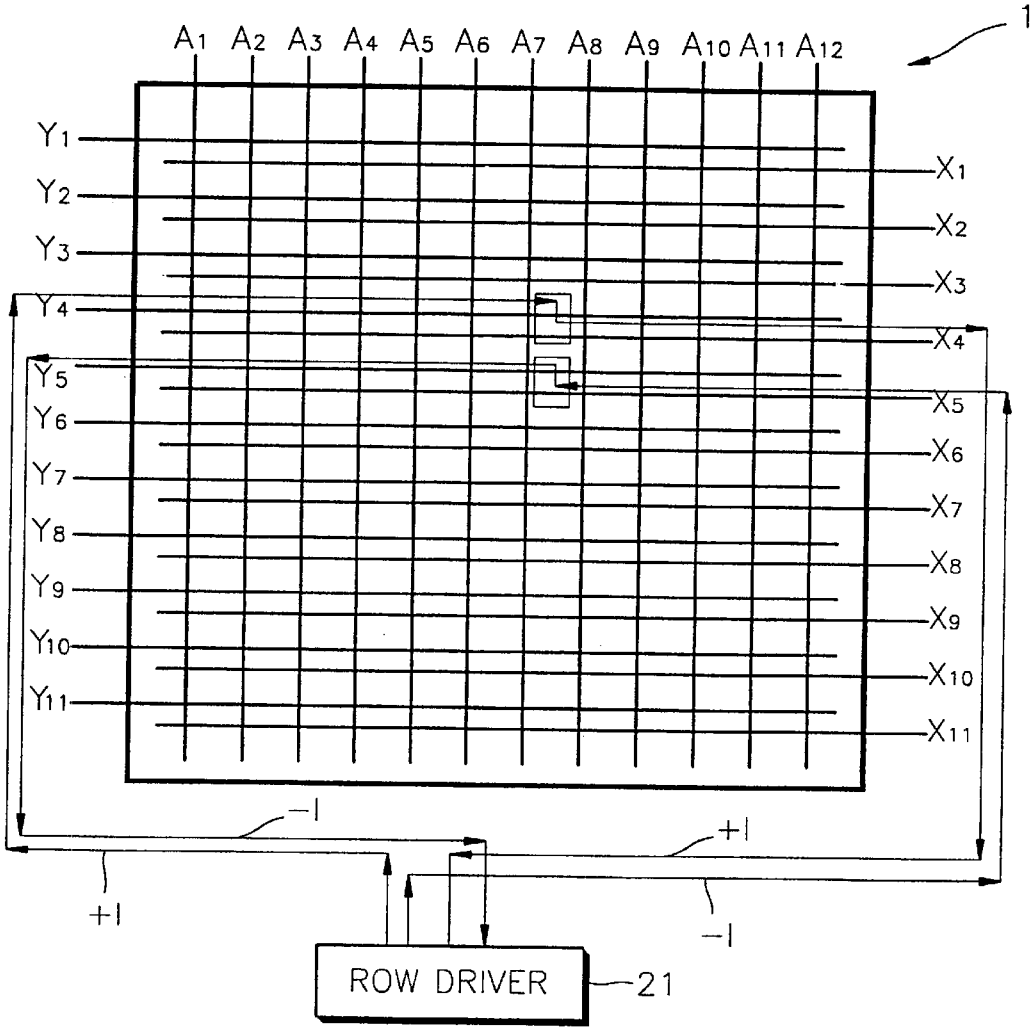
FIG. 7 illustrates current flow in the driving method shown in FIG. 4.

To sum up, alternating currents opposite to each other may flow among common electrode lines ($X_1, X_2, \ldots, X_{n-1}$ and $X_n$ of FIG. 1), and among scan electrode lines ($Y_1, Y_2, \ldots, Y_{n-1}$ and $Y_n$ of FIG. 1). Referring to FIG. 7, a first group, for example, will be described. The direction of the current flowing through front-part part row electrode lines $Y_1$, $X_1$, $Y_2$, $X_2$, $Y_3$, $X_3$, $Y_4$ and $X_4$ is opposite to that of rear-part row electrode lines $Y_5$, $X_5$, $Y_6$, $X_6$, $Y_7$, $X_7$, $Y_8$ and $X_8$. Accordingly, a side effect of offsetting electromagnetic interference is generated.

Figure 8:
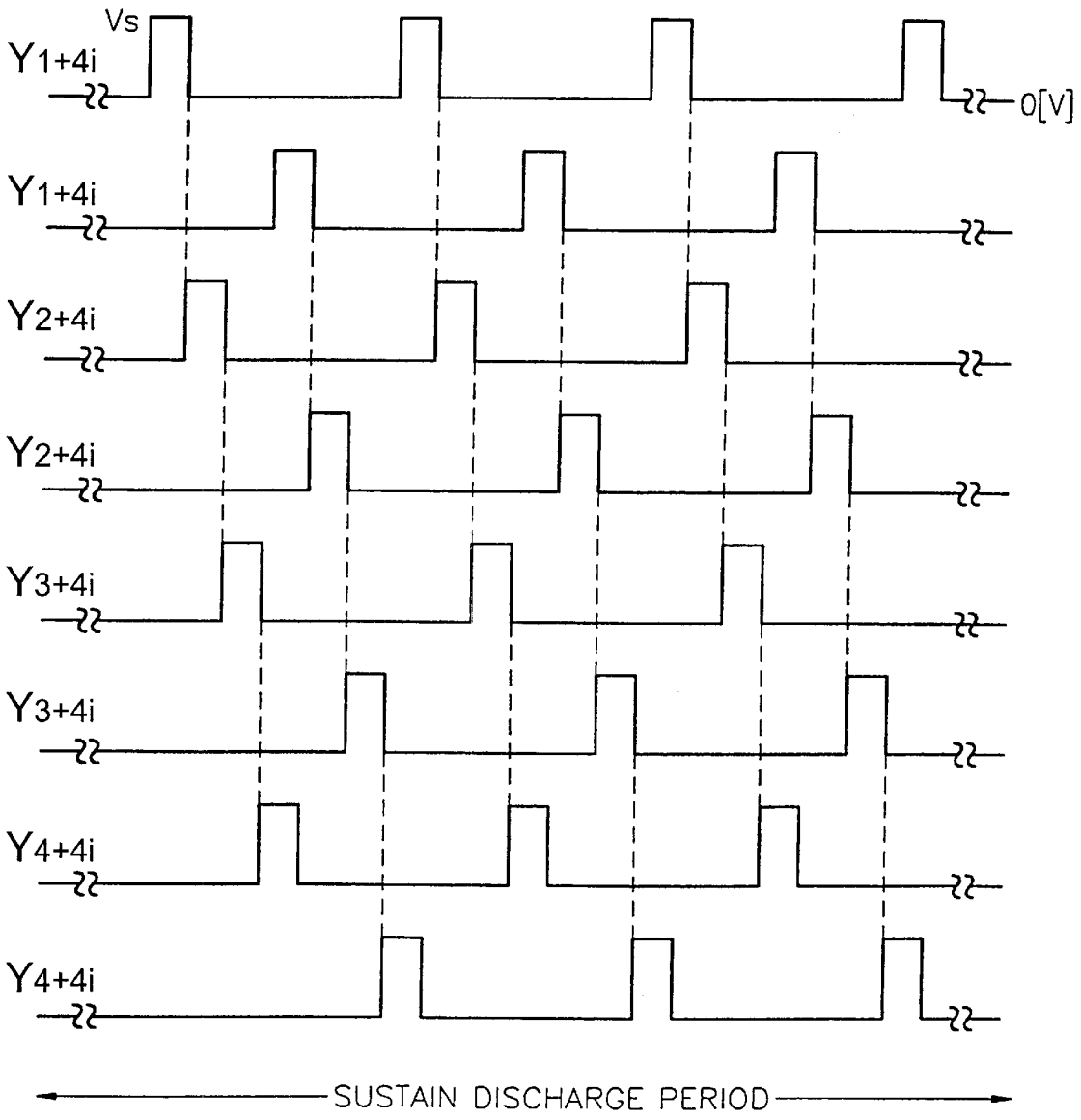
FIG. 8 is a timing diagram showing a method for driving a plasma display panel according to a second embodiment of the present invention.

FIG. 8 is a timing diagram showing a method for driving a plasma display panel according to a second embodiment of the present invention.

Referring to FIG. 8, the scan electrode lines ($Y_1, Y_2, \ldots, Y_{n-1}$ and $Y_n$ of FIG. 1) and the common electrode lines ($X_1, X_2, \ldots, X_{n-1}$ and $X_n$ of FIG. 1) are allocated into a plurality of groups. Each group has four scan electrode lines and four common electrode lines. For example, first through fourth scan electrode lines $Y_1$ through $Y_4$ and first through fourth common electrode lines $X_1$ through $X_4$ are allocated to a first group. Also, fifth through eighth scan electrode lines $Y_5$ through $Y_8$ and fifth through eighth common electrode lines $X_5$ through $X_8$ are allocated to a second group. To generalize this, (1+4i)-th scan electrode lines $Y_{1+4i}$ through $Y_{4+4i}$ and (1+4i)-th common electrode lines $X_{1+4i}$ through $X_{4+4i}$ are allocated to each group. Here, I is an integer ranging from zero.

In the sustain discharge period, alternating pulses are applied to the scan electrode lines $Y_{1+4i}, \ldots$ and $Y_{4+4i}$, and the common electrode lines $X_{1+4i}, \ldots$ and $X_{4+4i}$ belonging to each group with a time interval of a sustain discharge pulse width.

Figure 9:
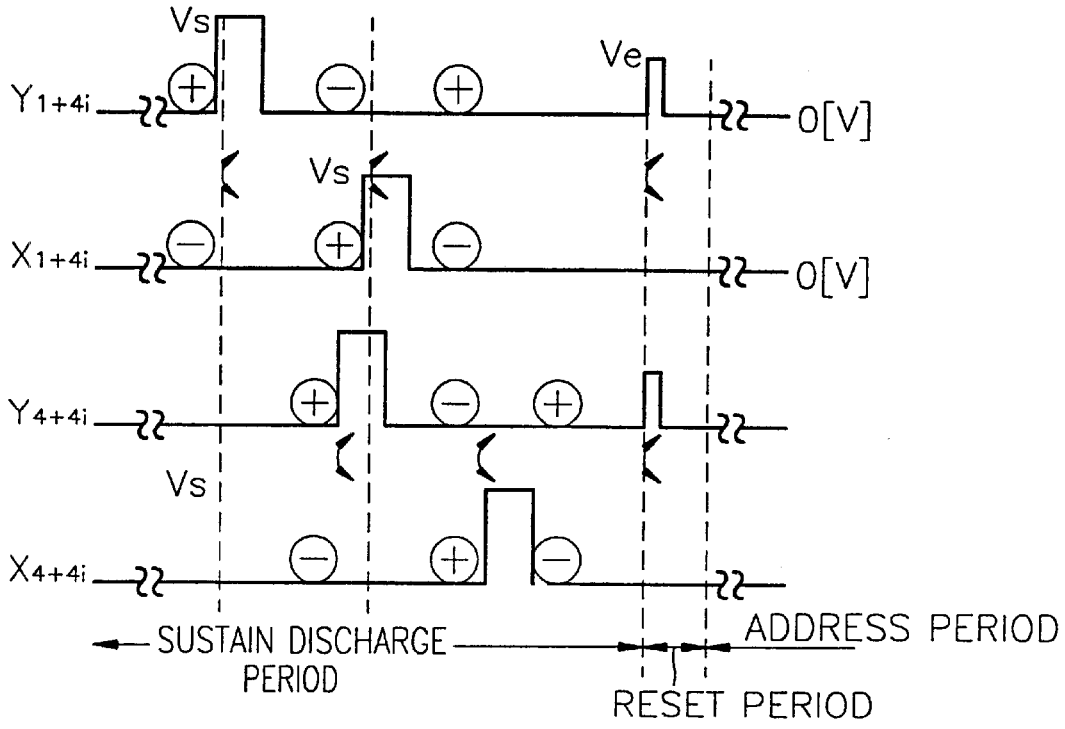
FIG. 9 shows extracted timing diagrams for explaining the driving method shown in FIG. 8.

Referring to FIG. 9, at the last timing of the sustain discharge period, wall charges produced around all scan electrode lines $Y_{1+4i}, \ldots$ and $Y_{4+4i}$ have the same polarity, that is, a positive polarity. Similarly, at this time, wall charges produced around all common electrode lines $X_{1+4i}, \ldots$ and $X_{4+4i}$ have the same polarity, that is, a negative polarity. Accordingly, in the reset period, positive pulses need only being applied to the scan electrode lines $Y_{1+8i}, \ldots$ around which the positive wall charges are produced, thereby simplifying the driving apparatus.

As described above, according to the driving method of a plasma display panel of the present invention, alternating pulses are applied to the scan electrode lines and the common electrode lines belonging to each group with a constant time interval in a sustain discharge period. Therefore, since the overall driving current flowing at a time at which alternating pulses are applied to all scan electrode lines or the common electrode lines, is considerably reduced, an electrical shock to the driving apparatus and the plasma display panel is prevented and the amount of electromagnetic interference reduced.

Although the invention has been described with respect to a preferred embodiment, it is not to be so limited as changes and modifications can be made which are within the full intended scope of the invention as defined by the appended claims.

What is claimed is:

1. A method for driving a plasma display panel in which a reset step of erasing remaining wall charges from a previous sub-field, an address step of forming wall charges in a selected pixel area, and a sustain discharge step of generating light from pixels where the wall charges are generated in the address step by applying alternating pulses to scan electrode lines and common electrode lines arranged parallel to each other, are sequentially performed in a unit sub-field, the method comprising:

allocating the scan electrode lines and the common electrode lines into a plurality of groups; and applying alternating pulses to the scan electrode lines and common electrode lines allocated to each group in the address step.

2. The method according to claim 1, wherein, in the sustain discharge step, the alternating pulses are applied to the respective scan electrode lines and a common scan electrode, not adjacent to the respective scan electrode lines, at the same time.

* * * * *